US005132654A

United States Patent [19]

Walgrove, III et al.

[11] Patent Number: 5,132,654

[45] Date of Patent: Jul. 21, 1992

[54] DEVICE FOR FACILITATING RECEIVER MEMBER SEPARATION

[75] Inventors: George R. Walgrove, III; Michael H. Parsons, both of Rochester, N.Y.

[73] Assignee: Eastman Kodak Company, Rochester, N.Y.

[21] Appl. No.: 531,658

[22] Filed: Jun. 1, 1990

[51] Int. Cl.[5] ..... G03G 21/00

[52] U.S. Cl. ..... 355/315; 355/274; 361/214; 361/221

[58] Field of Search ..... 355/315, 274, 219; 361/214, 221, 212, 225; 271/900, 307, 308; 346/153.1, 155, 160.1; 198/635

[56] References Cited

U.S. PATENT DOCUMENTS

| | | | |
|---|---|---|---|
| 3,508,824 | 4/1970 | Leinbach et al. | 355/315 |
| 3,757,164 | 9/1973 | Binkowski | 361/212 |
| 3,904,929 | 9/1975 | Kanaya et al. | 361/221 X |
| 4,062,631 | 12/1977 | Ichikawa et al. | 355/315 |
| 4,363,550 | 12/1982 | Toshimitsu et al. | 355/315 |
| 4,512,652 | 4/1985 | Buck et al. | 355/219 |
| 4,553,191 | 11/1985 | Franks, Jr. et al. | 361/212 |
| 4,579,441 | 4/1986 | Hart et al. | 355/315 |

FOREIGN PATENT DOCUMENTS

| | | | |
|---|---|---|---|
| 2343483 | 3/1975 | Fed. Rep. of Germany | 361/212 |
| 58-10764 | 1/1983 | Japan | 355/274 |
| 58-58570 | 4/1983 | Japan | 355/315 |
| 60-244982 | 12/1985 | Japan . | |
| 63-300271 | 12/1988 | Japan | 355/219 |

*Primary Examiner*—A. T. Grimley
*Assistant Examiner*—Shuk Y. Lee
*Attorney, Agent, or Firm*—Lawrence P. Kessler

[57] ABSTRACT

A device for assuring separation between a receiver member and a dielectric member in an electrostatographic reproduction apparatus. The electrostatographic reproduction apparatus includes a dielectric member adapted to carry a developed image, the dielectric member being movable along a travel path in which at some point the direction of travel is changed. Upstream of the change of direction of travel of the dielectric member, a mechanism is provided for electrostatically transferring a developed image from the dielectric member to a receiver member movable into register with the dielectric member. The separation device comprises an electrically conductive member of sharp edge configuration. The conductive member is located along a line transverse to and coincident with the desired travel path of the receiver member after separation of the lead edge of the receiver member from the dielectric member at a predetermined distance from the line of separation of the receiver member from the dielectric member as the dielectric member changes direction. Such predetermined distance is sufficient to enable separation of the lead edge of the receiver member from the dielectric member and approach contact with the receiver member to discharge electrical potential on the receiver member and prevent such electrical potential from effecting re-attachment of the receiver member to the dielectric member.

3 Claims, 1 Drawing Sheet

DEVICE FOR FACILITATING RECEIVER MEMBER SEPARATION

BACKGROUND OF THE INVENTION

This invention relates in general to separation of receiver members from dielectric members in electrostatographic reproduction apparatus, and more particularly to a grounded conductive member of sharp edge configuration positioned at a predetermined location for facilitating receiver member separation.

In typical electrostatographic reproduction apparatus or the like, an electrostatic latent image on a dielectric member is developed with pigmented marking particles. A receiver member, such as a sheet of plain bond paper for example, is brought into registered contact with the developed marking particle image on the dielectric member, and the marking particle image is electrostatically transferred to the receiver member. Thereafter, the receiver member is separated from the dielectric member and transported to a downstream device where the marking particle image is fixed to the receiver member by heat and/or pressure.

The electrostatic forces effecting transfer of the marking particle developed image to the receiver member also cause the receiver member to adhere to the dielectric member. Accordingly, it is a common practice in such reproduction apparatus to provide a device for effecting positive separation of the receiver member from the dielectric member after transfer. Such devices may be of the electrical type or of the mechanical type (or some combination thereof).

Electrical type separation devices typically employ a high voltage AC corona charger to neutralize the electrostatic charge causing the receiver member to adhere to the dielectric member thus facilitating the desired separation. The use of such chargers, however, requires that sufficient space be available within the reproduction apparatus. Moreover, they significantly increase the power demand, EMI noise and ozone generation of the apparatus. Mechanical type separation devices utilize for example relatively small diameter rollers in the dielectric member travel path or strippers in contact with the dielectric member. To effect separation with relatively small diameter rollers, the abrupt change in direction of the dielectric member moving about its travel path and the beam strength of the receiver member is relied upon to cause the lead edge of the receiver member to move in a straight line away from the dielectric member. However, due to handling constraints and core set concerns relative to the dielectric member ,there is a finite limit to the minimum diameter of the roller. Such minimum diameter may not be sufficiently small to provide the desired separation characteristics between the receiver member and the dielectric member. On the other hand, contact strippers must be carefully designed to prevent damage to the dielectric member at the contact interface. Additionally, the electrostatic forces causing adhesion of the receiver member to the dielectric member may sometimes be large enough to cause the strippers to damage the receiver member or dielectric member as they try to separate the receiver member from the dielectric member.

An example of a combined mechanical/electrical type separation device is shown in U.S. Pat. No. 3,508,824 issued Apr. 28, 1970, in the name of Lienbach et al. Such separation device employs an electrically grounded conductive plate extending from adjacent to a small diameter roller, for changing the direction of travel of a dielectric member, toward a downstream location. The change of direction of the dielectric member about the small diameter roller causes the lead edge of the receiver member to separate from the dielectric member. The receiver member is then attracted to the the grounded conductive plate, and moves along the plate to separate from the dielectric member as that portion of the receiver member still adhering to the dielectric member is moved with the dielectric member. The grounded conductive plate provides for attraction of the receiver member by assuming an electrical image charge opposite to that of the receiver member. However, depending on certain factors such as environmental conditions for example, the receiver member may not be sufficiently attracted to the conductive plate, or may be attracted to the plate with such an attractive force so as to inhibit smooth travel of the receiver member in the downstream direction.

SUMMARY OF THE INVENTION

This invention is directed to a device for assuring separation between a receiver member and a dielectric member in an electrostatographic reproduction apparatus, which is compact, inexpensive to implement, requires no additional electrical power, and overcomes the above described deficiencies with the above described prior separation devices. The electrostatographic reproduction apparatus includes a dielectric member adapted to carry a developed image, the dielectric member being movable along a travel path in which at some point the direction of travel is changed. Upstream of the change of direction of travel of the dielectric member, a mechanism is provided for electrostatically transferring a developed image from the dielectric member to a receiver member movable into register with the dielectric member. The separation device comprises an electrically conductive member of sharp edge configuration. The conductive member is located along a line transverse to and coincident with the desired travel path of the receiver member after separation of the lead edge of the receiver member from the dielectric member at a predetermined distance from the line of separation of the receiver member from the dielectric member as the dielectric member changes direction. Such predetermined distance is sufficient to enable separation of the lead edge of the receiver member from the dielectric member and approach contact with the receiver member to discharge electrical potential on the receiver member and prevent such electrical potential from effecting re-attachment of the receiver member to the dielectric member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
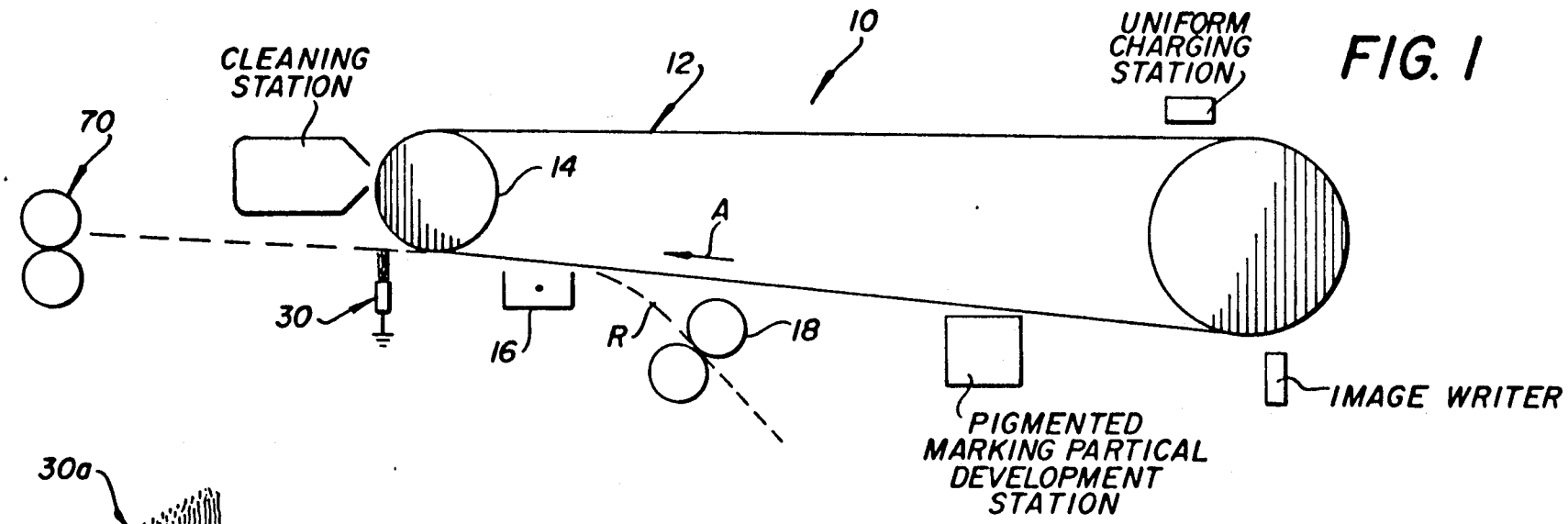
FIG. 1 is a aide elevational view, partly in cross-section and with portions removed to facilitate viewing, of an exemplary electrostatographic reproduction apparatus including the separation device according to this invention.

Referring now to the accompanying drawing, FIG. 1 schematically shows a portion of an exemplary electrostatographic reproduction apparatus designated generally by the numeral 10. The reproduction apparatus 10 includes a dielectric member 12, such as a grounded photoconductive web for example. The dielectric member 12 is adapted to move about a path in the direction of arrow A which is, at least in part, defined by a relatively small diameter roller 14 which serves to change direction of travel of the dielectric member. The travel path for the dielectric member brings the member into association with electrostatographic process stations spaced about such path. As the dielectric member 12 moves into association with the process stations, according to any well known electrostatographic process, the dielectric member 12 is uniformly charged with an electrical potential, and has the uniform charge altered in a latent image-wise pattern. Thereafter, the latent image charge pattern carried by the dielectric member is developed with pigmented marking particles.

A transfer device 16, such as a corona charger for example, is located upstream (relative to the direction of travel of the dielectric member 12) of the dielectric member direction changing roller 14. The transfer device 16 is connected to an electrical potential source (not shown) to selectively produce an electrostatic field which attracts a marking particle developed image from the dielectric member 12 to a receiver member R. The receiver member R is fed from a supply of receiver members (not shown) and transported by a mechanism 18, such as a pair of selectively driven nip rollers for example, into contact with the dielectric member 12 in register with a marking particle image on the moving dielectric member.

As is well known, the electrostatic transfer field produced by the transfer device 16 causes a charge to be deposited on a receiver member which not only effects transfer of the marking particle image to the receiver member but causes the receiver member to adhere to the dielectric member. Such attachment has a beneficial effect in that it enables movement of the dielectric member 12 to transport an attached receiver member over a portion of the desired travel path P of the receiver member from the transfer device 16 toward a downstream (in the direction of travel along such path) location. Such downstream location may include a fuser assembly 20 which fixes the transferred marking particle image to the receiver member by heat and/or pressure for example.

Figure 4:
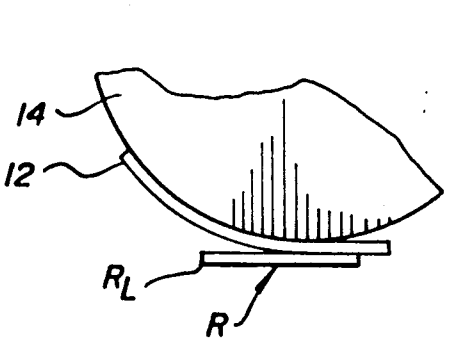
FIG. 4 is a side elevational view, on an enlarged scale, of a portion of FIG. 1 showing initial separation of the lead edge of a receiver member from a dielectric member.

In order for a receiver member to travel along its desired path P, the receiver member must be separated from the dielectric member 12 after transfer of the marking particle image from the dielectric member to the receiver member. The direction changing roller 14 serves to initiate such desired separation (see FIG. 4). That is, due to the inherent beam strength of the receiver member 12, the lead edge $R_L$ of the receiver member R will separate from the dielectric member 12 along a line L (into the plane of FIG. 4) where the dielectric member changes direction on passing about the roller 14.

Figure 5:
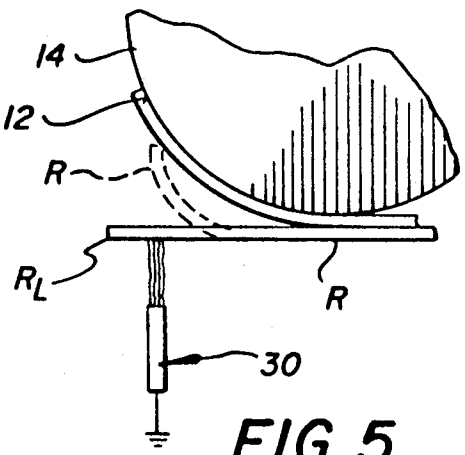
FIG. 5 is a side elevational view, on an enlarged scale, showing the effect of the separation device according to this invention on a receiver member.

However, on continued movement of the receiver member R along the path P, more of the receiver member separates from the dielectric member 12 and the stiffness in the separated portion decreases (see FIG. 5). At the same time, as the lead edge $R_L$ separates from the dielectric member 12, an air gap is formed between the receiver member and the dielectric member. The spaced portion of the receiver member and the dielectric member thus act substantially as a capacitor. Since the dimension between the receiver member and the dielectric member is increasing, with a substantially constant field between the receiver member and the dielectric member, the capacitance decreases and the surface potential on the receiver member increases rapidly. While at some point on continued separation air break down will occur, charge is still left on the receiver member. Along with the reduced stiffness in the receiver member, the charge differential between the receiver member and the dielectric member can be sufficient to re-attract the receiver member to the dielectric member (as shown in phantom lines in FIG. 5). This leads to misfeeding or jams in the reproduction apparatus which is of course undesirable.

Figure 2:
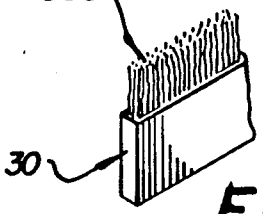
FIG. 2 is a view, in perspective, of a portion of the separation device of FIG. 1.
Figure 3:
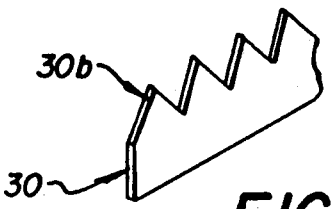
FIG. 3 is a view, in perspective, of a portion of an alternate embodiment of the separation device of FIG. 1.

Accordingly, the reproduction apparatus 10 includes a separation facilitating device of this invention, designated generally by the numeral 30. Such separation facilitating device 30 includes a grounded conductive member of sharp edge configuration. For example the sharp edge configuration may be established by a wire fiber brush 30*a* (see FIG. 2) or a saw-tooth shaped member 30*b* (see FIG. 3). The device 30 must be located in a predetermined position relative to the travel path P and the direction changing roller 14. For proper operation of the device 30, it must be located with the tips of the sharp edge configuration coincident with or closely adjacent to the path P. Further, the device must be spaced within a predetermined distance from the line of initial separation between the receiver member R and the dielectric member 12 as the dielectric member travels about the direction changing roller 14. The acceptable range of the predetermined distance is defined at the minimum as the distance from the line of initial separation where a substantial receiver potential has had time to build up on the receiver member, and at a maximum as the distance from the line of initial separation where the charge on the receiver will effect reattachment of the receiver member to the dielectric member. This range has been found to be approximately 4 mm to 10 mm when the roller 14 is of a diameter of approximately 35 mm and the receiver surface potential is on the order of 2000 v.

The sharp edge configuration for the device 30 is essential to operation of the device in that it concentrates the field between the surface of the receiver member and the device to effect discharge of the charge on the receiver member. Such discharge is accomplished even if the receiver member does not in fact contact the device 30; it merely has to come within close enough proximity to the receiver member to enable electrical break down to occur in the air gap between the receiver member and the tips of the sharp edge configuration. Therefore, on discharge of the receiver member, the attractive forces between the receiver member and the dielectric member are substantially eliminated and the receiver member is prevented from being brought back into attachment with the dielectric member. The receiver member is thus free to travel along the travel path P toward the fuser assembly 20 in the desired manner.

The invention has been described in detail with particular reference to preferred embodiments thereof, but it will be understood that variations and modifications can be effected within the spirit and scope of the invention.

We claim:

1. For use in an electrostatographic reproduction apparatus having a dielectric member adapted to carry a developed image, said dielectric member being movable along a travel path, means for changing direction of travel of said dielectric member in such travel path, and means located upstream in the direction of travel of said dielectric member for electrostatically transferring a developed image from said dielectric member to a receiver member movable into register with said dielectric member, a device for assuring separation of said receiver member from said dielectric member after transfer of said developed image from said dielectric member to said receiver member, said separation device comprising:

an electrically conductive member of sharp edge configuration, said conductive member being located along a line transverse to and coincident with the desired travel path of said receiver member after separation of the lead edge of said receiver member from said dielectric member at a predetermined distance from the line of separation of said receiver member from said dielectric member as the dielectric member moves about said direction changing means, in the range of approximately 4 mm to 10 mm, sufficient to enable separation of the lead edge of said receiver member from said dielectric member and approach contact with said receiver member to discharge electrical potential on said receiver member and prevent such electrical potential from effecting re-attachment of said receiver member to said dielectric member.

2. The invention of claim 1 wherein said conductive member is a fiber brush.

3. The invention of claim 1 wherein said conductive member is a blade of saw-tooth configuration.

* * * * *